US006855006B2

(12) United States Patent
Brooks et al.

(10) Patent No.: US 6,855,006 B2
(45) Date of Patent: Feb. 15, 2005

(54) HYBRID ELECTRICAL CONNECTOR FOR A LAMP-TO-HARNESS INTERFACE

(75) Inventors: Timothy W. Brooks, Madison, IN (US); Darren L. Harmon, Madison, IN (US); Don L. Weidman, Hanover, IN (US); Robert E. Fisher, Jr., Charleston, IN (US)

(73) Assignee: Grote Industries, Inc., Madison, IN (US)

( * ) Notice: Subject to any disclaimer, the term of this patent is extended or adjusted under 35 U.S.C. 154(b) by 0 days.

(21) Appl. No.: 10/017,827

(22) Filed: Dec. 7, 2001

(65) Prior Publication Data

US 2003/0224660 A1 Dec. 4, 2003

(51) Int. Cl.[7] ..... H01R 13/58
(52) U.S. Cl. ..... 439/606; 439/271
(58) Field of Search ..... 439/604, 606, 439/271, 272, 587, 276, 607, 588

(56) References Cited

U.S. PATENT DOCUMENTS 4,993,803 A * 2/1991 Suverison et al. ..... 439/78
5,560,981 A * 10/1996 Ito ..... 439/696
5,890,922 A * 4/1999 Buchter et al. ..... 439/284
5,928,023 A * 7/1999 Buckner et al. ..... 439/373
6,004,160 A * 12/1999 Korsunsky et al. ..... 439/660
6,059,594 A * 5/2000 Davis et al. ..... 439/275
6,273,729 B1 * 8/2001 Kelly ..... 439/586
6,315,609 B1 * 11/2001 Chung ..... 439/607

* cited by examiner

*Primary Examiner*—Briggitte R. Hammond
(74) *Attorney, Agent, or Firm*—Woodard, Emhardt, Moriarty, McNett & Henry LLP

(57) ABSTRACT

The present invention relates to a hybrid electrical connector for a lamp-to-harness interface, which comprises two connector halves. The first connector half includes an overmolded connector, preferably formed from injection molded PVC, which has terminals of a first sex at one end and wires at a second end. Each wire is electrically coupled to a respective one of the terminals. The overmolded connector has formed therearound a hard shell shroud which is substantially rigid and includes a first locking feature thereon. The second half of the connector comprises a hardshell connector having terminals of a second sex therein and a second locking feature thereon. By coupling the hardshell shroud to the hardshell connector and engaging the first and second locking features, the first terminals in the overmolded connector are caused to mate with the second terminals in the hardshell connector. In addition to the locking feature between the hardshell shroud and the hardshell connector, which provides a tactile indication of proper connector seating, both the hardshell shroud and hardshell connector may be formed in an asymmetrical shape which will ensure that the two connector halves are mated in the proper orientation. Further optional desirable features of the connector pair are described herein.

29 Claims, 4 Drawing Sheets

HYBRID ELECTRICAL CONNECTOR FOR A LAMP-TO-HARNESS INTERFACE

TECHNICAL FIELD OF THE INVENTION

The present invention generally relates to electrical connectors and, more particularly, to a hybrid electrical connector for a lamp-to-harness interface.

BACKGROUND OF THE INVENTION

There exist many applications for the use of electrical lamps on motor vehicles, such as automobiles and trucks. Large freight trucks, such as those having separable tractor and trailer combinations, utilize a particularly large number of lamps. Such trucks require lamps for sidemarking, braking, and turning indications, often numbering in the dozens of lamps.

Because these lamps are subject to failure from accident, corrosion caused by moisture from high pressure washing systems or other adverse chemical environments, vibration, mechanical failure, and the like, owners of such vehicles often find it necessary to replace the lamp units. Often, the lamp needs to be replaced while the truck is travelling away from its "home" repair facility. Each lamp manufacturer typically has its own proprietary connector system for connection of the lamp to the vehicle's wiring harness, thereby preventing interchangeability with other lamps available in the aftermarket for replacement in the event of a lamp or harness failure. This can result in downtime while waiting to find the same lamp or it may result in the mechanic cutting into the wiring harness in a makeshift way to connect a lamp not normally used on the vehicle. This type of repair compromises the wiring harness, often allowing corrosion to occur due to exposing the wiring to the environment. The trucking industry has therefore called for a standard system of connection that will allow any manufacturer's lamp to be replaced by any other manufacturer's lamp.

In response to this, the Society of Automotive Engineers (SAE) is proposing a new industry standard (SAE J2577) that will define rigid performance criteria for such lamps. SAE J2577 only specifies the configuration of the lamp side of the connection; manufacturers are free to design their own connectors to couple to the lamp. Among other things, SAE J2577 proposes to require a tactile indication that the connector is seated properly and a visual indication that the connector is properly oriented (i.e. a keyed connector).

Such functions are usually implemented by the use of hardshell technology where hard plastic male and female connectors mate to form the interface; however, their size and cost make them unattractive for most applications. Additionally, the necessary processes for incorporating hardshell connectors into a wiring harness require a great deal of process control to achieve the desired sealing and electrical characteristics. Internal seals are attached to each individual wire and internally between the male/female connector interface to form a watertight seal. This is an expensive approach because the number of components (four to six) and the additional labor required to assemble them to the wires and connector parts. Without tight manufacturing process controls, these connectors are prone to field failures. This same shortcoming also applies to the serviceability of the connection, since an improperly crimped or inserted terminal provides an entry point for moisture or other contaminants that may degrade the electrical performance of the circuit. Additionally, multiple connector types are required, depending upon the number of circuits utilized (e.g. two for marker functionality and three for marker and turn functionality); otherwise, a three-cavity connector must be used and the unused holes must be filled with a cavity plug. Failing to replace wire seals or cavity plugs during service is a major cause of premature connection failure.

Most of these sealing concerns are eliminated by overmolded connector solutions, in which a polyvinyl chloride (PVC) or another suitable compound is injection molded around one or more electrical terminals. In common practice, overmolded connectors are perceived as inferior due to their inability to properly mate or seal the lamp to the wiring harness due to their lack of operator feedback (visually or through tactile means) to communicate a solid connection. This can cause problems when the connectors are not fully seated, resulting in corrosion and premature failure of the lamp or harness. Most overmolded connectors also require the use of a dielectric compound to provide an additional barrier of protection against moisture, vibration and environmental contaminants.

There therefore exists a need for a lamp-to-harness connector that provides a tactile indication that it is seated properly and a visual indication that it is properly oriented, while avoiding many of the drawbacks of the hardshell connector technology. The present invention is directed toward meeting this need.

SUMMARY OF THE INVENTION

The present invention relates to a hybrid electrical connector for a lamp-to-harness interface, which comprises two connector halves. The first connector half includes an overmolded connector, preferably formed from injection molded PVC, which has terminals of a first sex at one end and wires at a second end. Each wire is electrically coupled to a respective one of the terminals. The overmolded connector has formed therearound a hard shell shroud which is substantially rigid and includes a first locking feature thereon. The second half of the connector comprises a hardshell connector having terminals of a second sex therein and a second locking feature thereon. By coupling the hardshell shroud to the hardshell connector and engaging the first and second locking features, the first terminals in the overmolded connector are caused to mate with the second terminals in the hardshell connector. In addition to the locking feature between the hardshell shroud and the hardshell connector, which provides a tactile indication of proper connector seating, both the hardshell shroud and hardshell connector may be formed in an asymmetrical shape which will ensure that the two connector halves are mated in the proper orientation. Further optional desirable features of the connector pair are described herein.

In one form of the present invention, a connector pair is disclosed, comprising an overmolded connector, comprising at least one first terminal having a first terminal sex; at least one wire respectively coupled for electrical communication with each of said at least one terminals; and an overmolded body having an overmolded connector terminal end, an overmolded connector wire end and an overmolded connector outer surface, said overmolded body at least partially encasing said at least one terminal and said at least one wire; a hardshell shroud having a first connector sex, said hardshell shroud comprising a substantially rigid shroud body having a shroud terminal end, a shroud wire end, a shroud inner surface and a shroud outer surface; wherein said overmolded connector is contained within said hardshell shroud; a hardshell connector housing having a second connector sex, said hardshell connector housing comprising at least one second terminal having a second terminal sex; a substantially rigid connector body having a connector body inner surface and a connector body outer surface; wherein said hardshell shroud may be interengaged with said hardshell connector, such that said at least one first terminal engages respective ones of said at least one second terminal.

In another form of the present invention, a connector pair is disclosed, comprising an overmolded connector, comprising at least one first terminal having a first terminal sex; at least one wire respectively coupled for electrical communication with each of said at least one terminals; and an overmolded body having an overmolded connector terminal end, an overmolded connector wire end and an overmolded connector outer surface, said overmolded body at least partially encasing said at least one terminal and said at least one wire; a hardshell shroud having a first connector sex, said hardshell shroud comprising a substantially rigid shroud body having a shroud terminal end, a shroud wire end, a shroud inner surface and a shroud outer surface, wherein said substantially rigid shroud body has an asymmetrical polarizing shape; an opening formed through the shroud wire end and allowing said at least one wire to pass therethrough; wherein said overmolded connector is contained within said hardshell shroud; a hardshell connector housing having a second connector sex, said hardshell connector housing comprising at least one second terminal having a second terminal sex; a substantially rigid connector body having a connector body inner surface and a connector body outer surface, wherein said substantially rigid connector body has the asymmetrical polarizing shape; wherein said hardshell shroud may be interengaged with said hardshell connector, such that said at least one first terminal engages respective ones of said at least one second terminal.

In yet another form of the present invention, a connector pair is disclosed, comprising an overmolded connector, comprising at least one first terminal having a first terminal sex; at least one wire respectively coupled for electrical communication with each of said at least one terminals; an injection molded PVC body having an overmolded connector terminal end, an overmolded connector wire end and an overmolded connector outer surface, said PVC body at least partially encasing said at least one terminal and said at least one wire; a plurality of annular sealing rings formed on the overmolded connector outer surface between the overmolded connector terminal end and the overmolded connector wire end; a first polarizing feature having a first polarizing sex formed on the overmolded connector outer surface adjacent the overmolded connector wire end; a raised sealing ridge formed around a periphery of the overmolded connector terminal end; and a reservoir formed within a boundary of said raised sealing ridge and adapted to contain a quantity of dielectric grease; a hardshell shroud having a first connector sex, said hardshell shroud comprising a substantially rigid shroud body having a shroud terminal end, a shroud wire end, a shroud inner surface and a shroud outer surface, wherein said substantially rigid shroud body has an asymmetrical polarizing shape; a second polarizing feature having a second polarizing sex formed on said shroud inner surface adjacent the shroud wire end; an opening formed through the shroud wire end and allowing said at least one wire to pass therethrough; at least one first locking feature formed on said substantially rigid shroud body and having a first locking feature sex; wherein said overmolded connector is contained within said hardshell shroud, such that said first and second polarizing features interengage; a hardshell connector housing having a second connector sex, said hardshell connector housing comprising at least one second terminal having a second terminal sex; a substantially rigid connector body having a connector body inner surface and a connector body outer surface, wherein said substantially rigid connector body has the asymmetrical polarizing shape; at least one second locking feature formed on said substantially rigid connector body outer surface and having a second locking feature sex; wherein said hardshell shroud may be interengaged with said hardshell connector, such that said at least one first terminal engages respective ones of said at least one second terminal; said plurality of annular sealing rings are held against the connector body inner surface; said raised sealing ridge is held against the connector body inner surface; and said first and second locking features lockingly interengage.

In another form of the present invention, a connector is disclosed, comprising an overmolded connector, comprising at least one first terminal having a first terminal sex; at least one wire respectively coupled for electrical communication with each of said at least one terminals; and an overmolded body having an overmolded connector terminal end, an overmolded connector wire end and an overmolded connector outer surface, said overmolded body at least partially encasing said at least one terminal and said at least one wire; a hardshell shroud having a first connector sex, said hardshell shroud comprising a substantially rigid shroud body having a shroud terminal end, a shroud wire end, a shroud inner surface and a shroud outer surface; wherein said overmolded connector is contained within said hardshell shroud.

DETAILED DESCRIPTION OF THE PREFERRED EMBODIMENTS

Figure 1:
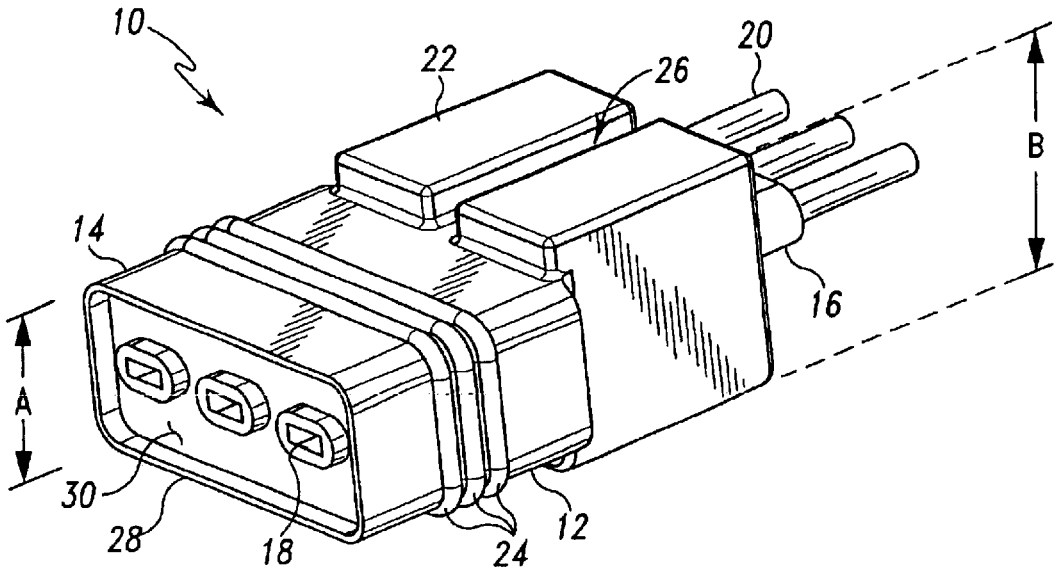
FIG. 1 is a first perspective view of an overmolded connector according to the present invention, said view showing the terminal end.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Figure 2:
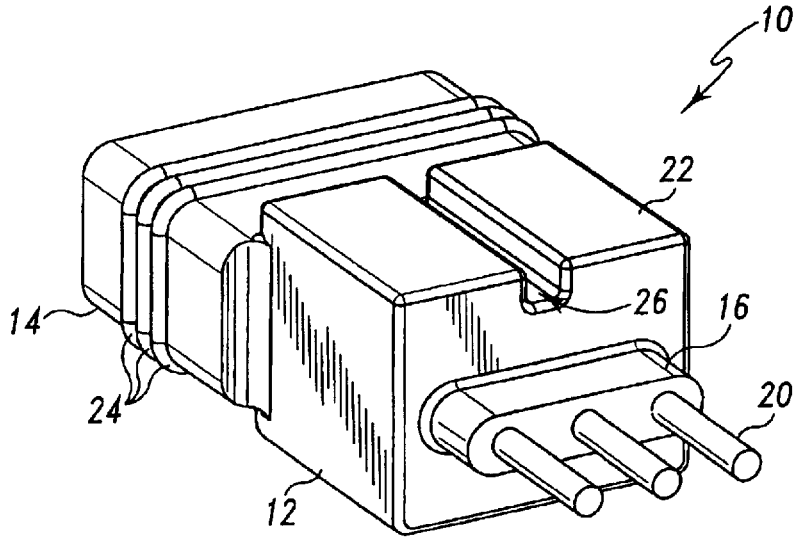
FIG. 2 is a second perspective view of an overmolded connector according to the present invention, said view showing the wire end.

The present invention overcomes the limitations in the prior art by using both overmolded and hardshell technologies in the same connector. With reference to FIGS. 1 and 2, there is illustrated an overmolded connector according to the present invention, and indicated generally at 10. The overmolded connector 10 includes a body 12 having an overmolded connector terminal end 14 and an overmolded connector wire end 16. One or more terminals 18 are disposed at the terminal end 14 and exhibit a first terminal sex. In a first preferred embodiment, the overmolded connector 10 includes two terminals 18 when the overmolded connector 10 is to be used to connect a wiring harness to a lamp having only a marking function. In a second preferred embodiment, the overmolded connector 10 includes three terminals 18 such that the overmolded connector 10 may be used to connect the wiring harness to a lamp having both marking and turn functions. At least one wire 20 exits the wire end 16 of the overmolded connector 10, each of the wires 20 being electrically coupled to a respective one of the terminals 18 within the body 12 of overmolded connector 10.

The overmolded connector 10 is formed from a moisture resistant material that is sealed around both the terminals 18 and the wires 20. In a preferred embodiment, the body 12 of the overmolded connector 10 is formed by injection molding polyvinyl chloride (PVC) around terminals 18 and wires 20, which are already electrically coupled to one another. This forms a seal between the PVC body 12 and the terminals 18 and wires 20, thereby making the overmolded connector 10 largely impervious to the effects of the environment. It will be appreciated that the body 12 may be formed from other materials which are known to be moisture-resistant and which may be molded into the body 12 in such a way as to form a seal around the terminals 18 and wires 20.

In the preferred embodiment of the present invention, the terminal end 14 of the body 12 has a dimension in at least one direction that is less than the dimension in the same direction of a mid-section 22 of the body 12. For example, in the preferred embodiment illustrated in FIGS. 1 and 2, the dimension A of terminal end 14 is less than the dimension B of mid-section 22. The purpose for this difference in dimension is described hereinbelow.

The overmolded connector 10 further includes at least one, and preferably three, annular sealing rings 24 on the outer surface thereof near the terminal end 14. Although the present invention comprehends that the annular sealing rings 24 may be discrete seals that are applied to the body 12, it is preferred that the annular sealing rings 24 are integrally formed when the body 12 is injection molded. The annular sealing rings 24 help to ensure a moisture-tight seal when the overmolded connector 10 is mated to a complimentary connector, as described in greater detail hereinbelow.

Figure 3:
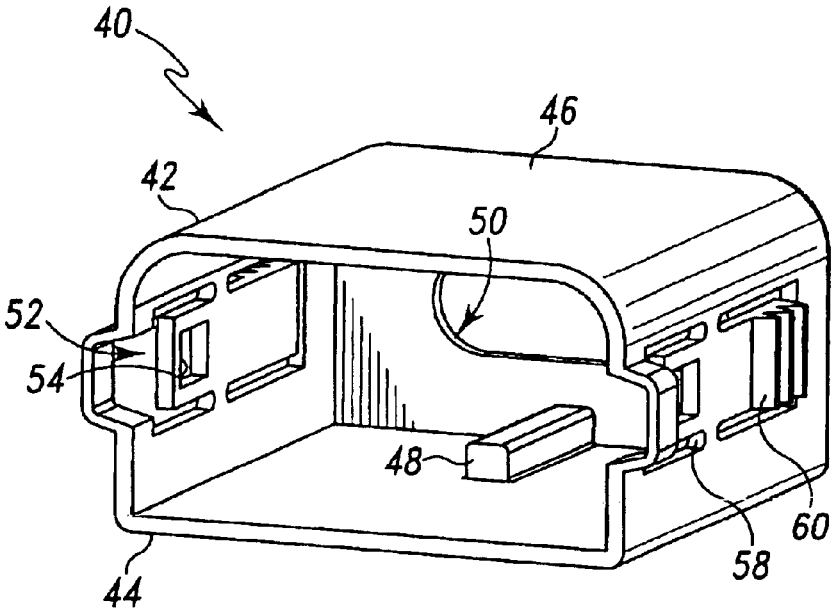
FIG. 3 is a first perspective view of a hardshell shroud according to the present invention, said view showing the hardshell shroud terminal end.

The overmolded connector 10 further preferably includes a polarizing feature, such as the channel 26 formed into the mid-section 22 of the body 12. In the embodiment illustrated in FIGS. 1 and 2, the polarizing feature 26 has a female sex, and its function is described hereinbelow with respect to FIGS. 3 and 4.

The terminal end 14 of the overmolded connector 10 preferably also includes a raised sealing ridge 28 formed around the periphery of the terminal end 14. This raised sealing ridge 28 defines a reservoir 30 within its boundary. The reservoir 30 allows a quantity of dielectric grease (not shown) to be inserted into each of the connectors 14, and any grease that is ejected therefrom upon mating will be contained within the reservoir 30 in order to prevent hydraulic forces from preventing proper seating of the overmolded connector 10 to its mating connector.

Figure 4:
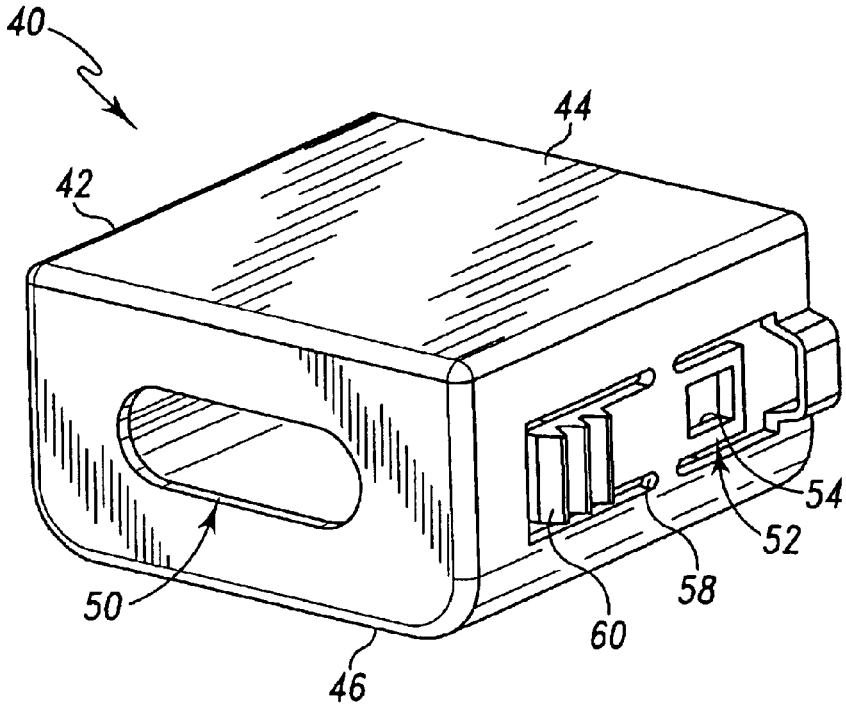
FIG. 4 is a second perspective view of a hardshell shroud according to the present invention, said view showing the hardshell shroud wire end.

Referring now to FIG. 4, there is illustrated a hardshell shroud of the present invention, indicated generally at 40. The hardshell shroud 40 comprises a substantially rigid shroud body 42 having a shroud terminal end 44 and a shroud wire end 46. In the preferred embodiment, the substantially rigid shroud body 42 is formed from a substantially rigid plastic, but the present invention comprehends the hardshell shroud 40 being formed from any substantially rigid or rigid material.

Hardshell shroud 40 includes a polarizing feature 48 formed on an inside surface thereof. The polarizing feature 48 has a sex opposite that of the polarizing feature 26 of the overmolded connector 10. In the preferred embodiment illustrated in FIG. 3, the polarizing feature 48 comprises a raised male rib that is designed to interengage with the channel 26 of overmolded connector 10 when the connector 10 is inserted into the hardshell shroud 40. The use of the polarizing features 26, 48 ensure that the overmolded connector 10 can only be inserted into the hardshell shroud 40 in a single orientation. The usefulness of this feature is described in greater detail hereinbelow with reference to FIG. 6.

The wire end 46 of hardshell shroud 40 includes an opening 50 formed therein. The opening 50 provides a space for the wires 20 of the overmolded connector 10 to exit the wire end 46 of the shroud 40. In the preferred embodiment, the wire end 16 of the overmolded connector 10 has a shape and dimensions substantially identical to the opening 50, such that an interference fit is formed therebetween.

The hardshell shroud 40 preferably includes at least one, and preferably two, locking features 52. Locking features 52 are used to lock the hardshell shroud 40 to the mating connector. In the preferred embodiment, the locking features 52 include openings 54 therein situated at the terminal end of the locking feature 52. These openings 54 interengage with a second locking feature 56 formed on the mating connector (see FIG. 5). In the preferred embodiment, this second locking feature has a ramp configuration which causes the first locking feature 52 to pivot outward as it is pushed over the second locking feature 56, and then to snap back to its original position at the end of the ramp of the second locking feature 56. Once snapped back into the original position, the second locking feature 56 prevents removal of the hardshell shroud 40, thereby assuring that the two connector halves remain mated.

The first locking feature 52 is preferably formed in the sides of the hardshell shroud 40 and attached thereto only by means of relatively narrow connecting tabs 58. The connecting tabs 58 facilitate the pivoting motion of the first locking features 52 as they interengage the second locking features 56. The first locking feature 52 also preferably extends from the connecting tabs 58 toward the wire end 46 of the hardshell shroud 40, and thereby provides gripping surfaces 60 which may be squeezed inwardly by the operator coupling the two connector halves, thereby facilitating clearance of the second locking feature 56 by the first locking feature 52.

Figure 5:
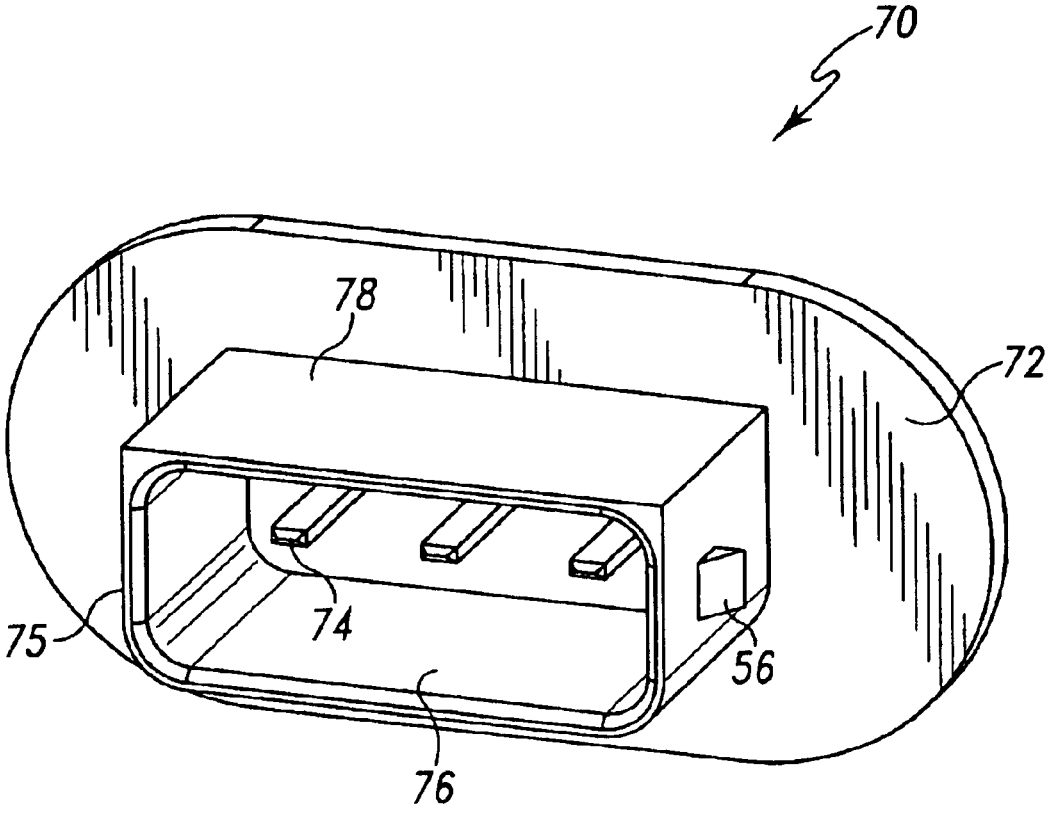
FIG. 5 is a perspective view of a hardshell connector according to the present invention.

Referring now to FIG. 5, there is illustrated a preferred embodiment hardshell connector housing of the present invention, indicated generally at 70. As with the hardshell shroud 40, the hardshell connector housing 70 is preferably formed from a substantially rigid plastic or other substantially rigid or rigid material. As discussed hereinabove, the hardshell connector 70 is configured to mate with the overmolded connector 10/hardhsell shroud 40 combination of the present invention. In a preferred embodiment, the overmolded connector 10 is coupled to a vehicular wiring harness and the hardshell connector 70 is coupled to a vehicular lamp, either by being integrally molded with the housing 72 of said lamp, as shown in FIG. 5, or by being coupled to said lamp by means of connecting wires (not shown).

The hardshell connector 70 includes at least one terminal 74 having a second sex opposite that of the terminal 18 in the overmolded connector 10, such that the terminals 74 will mate with the terminals 18 when the two connector halves are interengaged. It is preferred that the hardshell connector 70 have the same number of terminals 74 as the number of terminals 18 in the overmolded connector 10. The hardshell connector 70 includes a substantially rigid connector body 75 defining a connector body inner surface 76 and a connector body outer surface 78. As described hereinabove, the locking features 56 are situated on the connector body outer surface 78.

In the preferred embodiment, both the hardshell shroud 40 and the hardshell connector 70 are formed in an asymmetrical polarizing shape which requires a specific orientation between the overmolded connector 10 and the hardshell connector 70 in order to mate the connector halves in the illustrated embodiment, both the hardshell shroud 40 and the hardshell connector 70 are substantially D-shaped. This shape ensures that the connectors cannot be rotated 180 degrees and coupled.

Figure 6:
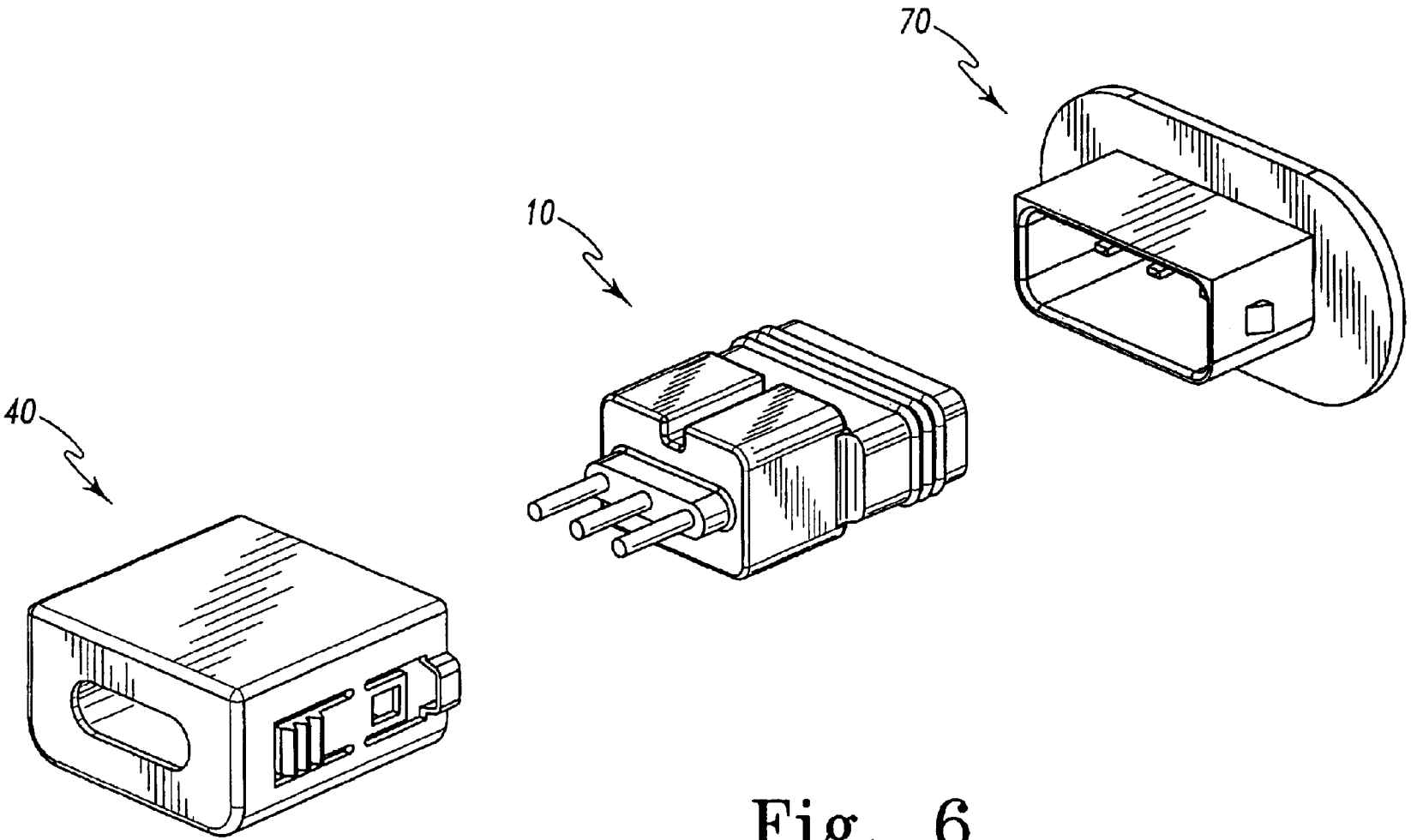
FIG. 6 is an exploded perspective view showing the overmolded connector, hardshell shroud and hardshell connector of the present invention.

Referring now to FIG. 6, there is shown an exploded view of the hardshell shroud 40, overmolded connector 10 and hardshell connector 70. As can be seen by the drawing, the overmolded connector 10 fits inside the hardshell shroud 40, with the polarizing features 26 and 48 ensuring that the hardshell shroud 40 and overmolded connector 10 are maintained in a predetermined orientation. Preferably, the dimension B of the overmolded connector 10 is substantially the same as the inner height of the hardshell shroud 40, such that the two pieces fit together in an interference fit. Once mated together, the wires 20 on the wire end 16 of the overmolded connector 10 protrude through the opening 50 on the hardshell shroud 40. Furthermore, because the dimension A of the terminal end 14 is less than the dimension B, an annular space is maintained between the terminal end 14 of the overmolded connector 10 and the interior surface of the hardshell shroud 40. This annular space provides room for the body 75 of the hardshell connector 70 to be inserted between the overmolded connector 10 and the hardshell shroud 40, allowing interengagement of the terminals 18 and the terminals 74. Furthermore, when the connector body 75 is inserted into this annular space, the locking members 56 lockingly interengage with the openings 54 of the locking members 52. Once locked in this position, the raised sealing ridge 28 of the overmolded connector 10 is held firmly against the back wall of the hardshell connector 70, thereby enclosing the reservoir 30 and containing any dielectric grease which may have been forced from the terminals 14 within the boundaries of the raised sealing ridge 28. Also, mating of the two connector halves causes the annular sealing rings 24 of the overmolded connector 10 to seal against the inner surface 76 of the hardshell connector 70.

It will be appreciated that the preferred embodiment disclosed herein illustrates the overmolded connector 10 as having a male sex and the hardshell connector 70 as having a female sex. Those having ordinary skill in the art will recognize that the sexes of the two connector halves may be reversed without departing from the principles disclosed and claimed herein.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A connector pair, comprising:

an overmolded connector, comprising:

at least one first terminal having a first terminal sex;

at least one wire respectively coupled for electrical communication with each of said at least one terminals; and an overmolded body having an overmolded connector terminal end, an overmolded connector wire end and an overmolded connector outer surface, said overmolded body at least partially overmolded around said at least one terminal and said at least one wire;

a hardshell shroud having a first connector sex, said hardshell shroud comprising:

a substantially rigid shroud body having a shroud terminal end, a shroud wire end, a shroud inner surface, a shroud outer surface, and an opening formed through the shroud wire end and allowing said at least one wire to pass therethrough;

wherein said overmolded connector is contained within said hardshell shroud;

a hardshell connector housing having a second connector sex, said hardshell connector housing comprising:

at least one second terminal having a second terminal sex;

a substantially rigid connector body having a connector body inner surface and a connector body outer surface;

wherein said hardshell shroud may be interengaged with said hardshell connector, such that said at least one first terminal engages respective ones of said at least one second terminal.

2. The connector pair of claim 1, wherein said overmolded body comprises injection molded PVC.

3. The connector pair of claim 1, further comprising:

a plurality of annular sealing rings formed on the overmolded connector outer surface between the overmolded connector terminal end and the overmolded connector wire end;

wherein said plurality of annular sealing rings are held against the connector body inner surface when said hardshell shroud is interengaged with said hardshell connector.

4. The connector pair of claim 1, further comprising a raised sealing ridge formed around a periphery of the overmolded connector terminal end; and a reservoir formed within a boundary of said raised sealing ridge and adapted to contain a quantity of dielectric grease;

wherein said raised sealing ridge is held against the connector body inner surface when said hardshell shroud is interengaged with said hardshell connector.

5. The connector pair of claim 1, further comprising:

a first polarizing feature having a first polarizing sex formed on the overmolded connector outer surface adjacent the overmolded connector wire end.

6. The connector pair of claim 5, further comprising:

a second polarizing feature having a second polarizing sex formed on said shroud inner surface adjacent the shroud wire end, such that said first and second polarizing features interengage.

7. The connector pair of claim 1, wherein said substantially rigid shroud body has an asymmetrical polarizing shape.

8. The connector pair of claim 7, wherein said substantially rigid connector body has the asymmetrical polarizing shape.

9. The connector pair of claim 1, further comprising:

at least one first locking feature formed on said substantially rigid shroud body and having a first locking feature sex.

10. The connector pair of claim 9, further comprising:

at least one second locking feature formed on said substantially rigid connector body outer surface and having a second locking feature sex, such that said first and second locking features lockingly interengage.

11. A connector pair, comprising:

an overmolded connector, comprising:

at least one first terminal having a first terminal sex;

at least one wire respectively coupled for electrical communication with each of said at least one terminals; and an overmolded body having an overmolded connector terminal end, an overmolded connector wire end and an overmolded connector outer surface, said overmolded body at least partially overmolded around said at least one terminal and said at least one wire;

a hardshell shroud having a first connector sex, said hardshell shroud comprising:

a substantially rigid shroud body having a shroud terminal end, a shroud wire end, a shroud inner surface and a shroud outer surface, wherein said substantially rigid shroud body has an asymmetrical polarizing shape;

an opening formed through the shroud wire end and allowing said at least one wire to pass therethrough;

wherein said overmolded connector is contained within said hardshell shroud;

a hardshell connector housing having a second connector sex, said hardshell connector housing comprising:

at least one second terminal having a second terminal sex;

a substantially rigid connector body having a connector body inner surface and a connector body outer surface, wherein said substantially rigid connector body has the asymmetrical polarizing shape;

wherein said hardshell shroud may be interengaged with said hardshell connector, such that said at least one first terminal engages respective ones of said at least one second terminal.

12. The connector pair of claim 11, wherein said overmolded body comprises injection molded PVC.

13. The connector pair of claim 11, further comprising:

a plurality of annular sealing rings formed on the overmolded connector outer surface between the overmolded connector terminal end and the overmolded connector wire end;

wherein said plurality of annular sealing rings are held against the connector body inner surface when said hardshell shroud is interengaged with said hardshell connector.

14. The connector pair of claim 11, further comprising a raised sealing ridge formed around a periphery of the overmolded connector terminal end; and a reservoir formed within a boundary of said raised sealing ridge and adapted to contain a quantity of dielectric grease;

wherein said raised sealing ridge is held against the connector body inner surface when said hardshell shroud is interengaged with said hardshell connector.

15. The connector pair of claim 11, further comprising:

a first polarizing feature having a first polarizing sex formed on the overmolded connector outer surface adjacent the overmolded connector wire end.

16. The connector pair of claim 15, further comprising:

a second polarizing feature having a second polarizing sex formed on said shroud inner surface adjacent the shroud wire end, such that said first and second polarizing features interengage.

17. The connector pair of claim 11, further comprising:

at least one first locking feature formed on said substantially rigid shroud body and having a first locking feature sex.

18. The connector pair of claim 17, further comprising:

at least one second locking feature formed on said substantially rigid connector body outer surface and having a second locking feature sex, such that said first and second locking features lockingly interengage.

19. A connector pair, comprising:

an overmolded connector, comprising:

at least one first terminal having a first terminal sex;

at least one wire respectively coupled for electrical communication with each of said at least one terminals;

an injection molded PVC body having an overmolded connector terminal end, an overmolded connector wire end and an overmolded connector outer surface, said PVC body at least partially encasing said at least one terminal and said at least one wire;

a plurality of annular sealing rings formed on the overmolded connector outer surface between the overmolded connector terminal end and the overmolded connector wire end;

a first polarizing feature having a first polarizing sex formed on the overmolded connector outer surface adjacent the overmolded connector wire end;

a raised sealing ridge formed around a periphery of the overmolded connector terminal end; and a reservoir formed within a boundary of said raised sealing ridge and adapted to contain a quantity of dielectric grease;

a hardshell shroud having a first connector sex, said hardshell shroud comprising:

a substantially rigid shroud body having a shroud terminal end, a shroud wire end, a shroud inner surface and a shroud outer surface, wherein said substantially rigid shroud body has an asymmetrical polarizing shape;

a second polarizing feature having a second polarizing sex formed on said shroud inner surface adjacent the shroud wire end;

an opening formed through the shroud wire end and allowing said at least one wire to pass therethrough;

at least one first locking feature formed on said substantially rigid shroud body and having a first locking feature sex;

wherein said overmolded connector is contained within said hardshell shroud, such that said first and second polarizing features interengage;

a hardshell connector housing having a second connector sex, said hardshell connector housing comprising:

at least one second terminal having a second terminal sex;

a substantially rigid connector body having a connector body inner surface and a connector body outer surface, wherein said substantially rigid connector body has the asymmetrical polarizing shape;

at least one second locking feature formed on said substantially rigid connector body outer surface and having a second locking feature sex;

wherein said hardshell shroud may be interengaged with said hardshell connector, such that:

said at least one first terminal engages respective ones of said at least one second terminal;

said plurality of annular sealing rings are held against the connector body inner surface;

said raised sealing ridge is held against the connector body inner surface; and said first and second locking features lockingly interengage.

20. A connector, comprising:

an overmolded connector, comprising:

at least one first terminal having a first terminal sex;

at least one wire respectively coupled for electrical communication with each of said at least one terminals;

an overmolded body having an overmolded connector terminal end, an overmolded connector wire end and an overmolded connector outer surface, said overmolded body at least partially encasing said at least one terminal and said at least one wire;

a raised sealing ridge formed around a periphery of the overmolded connector terminal end; and a reservoir formed within a boundary of said raised sealing ridge and adapted to contain a quantity of dielectric grease;

a hardshell shroud having a first connector sex, said hardshell shroud comprising:

a substantially rigid shroud body having a shroud terminal end, a shroud wire end, a shroud inner surface and a shroud outer surface;

a hardshell connector housing having a second connector sex, said hardshell connector housing comprising:

at least one second terminal having a second terminal sex;

a substantially rigid connector body having a connector body inner surface and a connector body outer surface;

wherein said hardshell shroud may be interengaged with said hardshell connector, such that said at least one first terminal engages respective ones of said at least one second terminal, wherein said overmolded connector is contained within said hardshell shroud, and wherein said raised sealing ridge is held against the connector body inner surface when said hardshell shroud is interengaged with said hardshell connector.

21. The connector of claim 20, wherein said overmolded body comprises injection molded PVC.

22. The connector of claim 20, further comprising:

a plurality of annular sealing rings formed on the overmolded connector outer surface between the overmolded connector terminal end and the overmolded connector wire end;

wherein said plurality of annular sealing rings are held against the connector body inner surface when said hardshell shroud is interengaged with said hardshell connector.

23. The connector pair of claim 20, wherein said substantially rigid shroud body has an opening formed through the shroud wire end and allowing said at least one wire to pass therethrough.

24. The connector pair of claim 20, further comprising:

at least one first locking feature formed on said substantially rigid shroud body and having a first locking feature sex.

25. The connector pair of claim 24, further comprising:

at least one second locking feature formed on said substantially rigid connector body outer surface and having a second locking feature sex, such that said first and second locking features lockingly interengage.

26. The connector of claim 20, further comprising:

a first polarizing feature having a first polarizing sex formed on the overmolded connector outer surface adjacent the overmolded connector wire end.

27. The connector of claim 26, further comprising:

a second polarizing feature having a second polarizing sex formed on said shroud inner surface adjacent the shroud wire end, such that said first and second polarizing features interengage.

28. The connector of claim 20, wherein said substantially rigid shroud body has an asymmetrical polarizing shape.

29. The connector of claim 28, wherein said substantially rigid connector body has the asymmetrical polarizing shape.

* * * * *